US009502746B2

(12) United States Patent
Fasenfest

(10) Patent No.: US 9,502,746 B2
(45) Date of Patent: Nov. 22, 2016

(54) 180 DEGREE HYBRID COUPLER AND DUAL-LINEARLY POLARIZED ANTENNA FEED NETWORK

(71) Applicant: Tyco Electronics Corporation, Berwyn, PA (US)

(72) Inventor: Kathleen Fasenfest, Union City, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/613,902

(22) Filed: Feb. 4, 2015

(65) Prior Publication Data

US 2016/0226124 A1 Aug. 4, 2016

(51) Int. Cl.

| | |
|---|---|
| ***H01P 5/16*** | (2006.01) |
| ***H01P 5/12*** | (2006.01) |
| *H01P 5/18* | (2006.01) |

(52) U.S. Cl.

CPC ..... *H01P 5/12* (2013.01)

(58) Field of Classification Search

CPC ..... H01P 5/16; H01P 5/18

USPC ..... 333/109–112, 116–118

See application file for complete search history.

(56) References Cited

U.S. PATENT DOCUMENTS

| | | | | |
|---|---|---|---|---|
| 5,742,901 | A | 4/1998 | Nishida | |
| 5,745,017 | A * | 4/1998 | Ralph | H01F 17/0006 329/354 |
| 7,042,309 | B2 * | 5/2006 | Podell | H01P 5/187 333/112 |
| 7,319,370 | B2 * | 1/2008 | Napijalo | H01P 5/185 333/116 |
| 7,345,557 | B2 * | 3/2008 | Podell | H01P 5/187 333/109 |
| 7,495,525 | B2 * | 2/2009 | Ilkov | H01F 17/0013 333/26 |
| 7,541,890 | B2 * | 6/2009 | Cheung | H01P 1/10 333/117 |

FOREIGN PATENT DOCUMENTS

| | | |
|---|---|---|
| EP | 0524000 A1 | 1/1993 |
| EP | 0769847 A1 | 4/1997 |
| FR | 2232155 A1 | 12/1974 |
| GB | 859119 A | 1/1961 |
| GB | 2399951 A | 9/2004 |

OTHER PUBLICATIONS

International Search Report for International Application No. PCT/US2016/016009, mailed May 17, 2016.

Zhang, Zhen-Yu et al., "A New Planar Marchand Balun," 2005 IEEE MTT-S International Microwave Symposium, Piscataway, NJ, USA, IEEE, Jun. 12, 2005, pp. 1207-1210.

* cited by examiner

*Primary Examiner* — Dean Takaoka

(57) ABSTRACT

A 180° hybrid coupler includes three coupled-line couplers connected between two inputs and two outputs. Each of the three coupled-line couplers is defined by at least one ground conductor and only two signal conductors.

20 Claims, 8 Drawing Sheets

180 DEGREE HYBRID COUPLER AND DUAL-LINEARLY POLARIZED ANTENNA FEED NETWORK

BACKGROUND

The subject matter disclosed herein relates generally to 180° hybrid couplers and dual-linearly polarized antenna feed networks for four-port antennas.

Hybrid couplers (also referred to as "Hybrid junctions") are four-port circuits that combine two input signals to create two output signals. Generally, the two output signals from a hybrid coupler are approximately equal in amplitude. Hybrid couplers are named according to the phase difference between their two output ports, with 0°, 90°, and 180° hybrid couplers being the most common configurations. Hybrid couplers are used in a wide variety of applications such as, but not limited to, feed networks, balanced mixers, impedance measuring devices, modulators, phase adjusters, tuners, and comparators.

Known 180° hybrid couplers are not without disadvantages. For example, at least some known 180° hybrid couplers are larger than desired, which may increase the size of a host device, limit the number of hybrid couplers used in a host device (e.g., a feed network) and/or with an associated device (e.g., an antenna), limit the number of host devices and/or associated devices that can be arranged in an available space, and/or the like. Moreover, at least some known 180° hybrid couplers are difficult to manufacture, which may increase cost and/or limit utility of such hybrid couplers.

Another disadvantage of at least some known 180° hybrid couplers is a relatively narrow bandwidth. For example, when used within a feed network associated with an antenna, the operational frequency band of at least some known 180° hybrid couplers may be too narrow to enable the antenna to communicate with one or more devices. Moreover, at least some known 180° hybrid couplers may not operate at relatively high frequencies (e.g., frequencies above one Gigahertz and/or the like), which may prevent a host device and/or an associated device from operating at such frequencies.

Feed networks are used to feed radio frequency (RF) energy between an antenna and an associated electronic system that includes a transmitter, a receiver, and/or a transceiver. For example, feed networks may convert RF waves received by an antenna into RF electrical signals and deliver the RF electrical signals to the associated electronic system, and/or vice versa. Known feed networks may include one or more hybrid couplers (and/or other components such as, but not limited to, baluns, delay lines, and/or the like) for controlling the phase of RF energy at the antenna. As discussed above, a hybrid coupler generates two output signals that have approximately equal amplitude and may have a phase difference of 0°, 90°, and/or 180°.

Known feed networks are not without disadvantages. For example, a plurality of antennas is often grouped together in an array. Each antenna includes a dedicated feed network that serves the particular antenna. Accordingly, the antenna array includes a plurality of antenna and feed network pairs. But, there may be a limited amount of space for containing the antenna and feed network pairs, which may limit the number of antennas that can be included within the array. For example, the length, width, and/or a similar dimension (e.g., a diameter and/or the like) of at least some known feed networks may limit the number of antennas that can be arranged in the available space.

Another disadvantage of at least some known feed networks is bandwidth. Specifically, the operational frequency band of at least some known feed networks may be too narrow to enable the associated antenna to communicate with one or more devices. For example, global navigation satellite systems (GNSSs) transmit over multiple frequency bands. Connectivity to multiple frequency bands of multiple satellite systems enables more reliable and more accurate estimation of location and timing for navigation applications compared with connectivity at a single frequency of a single satellite system. The frequency band of at least some known feed networks may be too narrow to enable the associated antenna to communicate with one or more of the different GNSS satellite constellation operating bands. Specifically, at least some known feed networks operate over a relatively narrow frequency band that does not overlap the frequency band of one or more of the different GNSS satellite constellations. The associated antenna therefore cannot communicate with such a GNSS satellite constellation because the feed network does not operate within the frequency band of the GNSS satellite constellation. Moreover, the frequency band of at least some known feed networks may be so narrow that the associated antenna is limited to communicating with a particular GNSS satellite constellation using only portion (i.e., a sub-band) of the frequency band of the GNSS satellite.

BRIEF DESCRIPTION

In an embodiment, a 180° hybrid coupler includes a circuit having first and second inputs and first and second outputs. The circuit includes first, second, and third coupled-line couplers and a transmission line. Each of the first, second, and third coupled-line couplers is defined by at least one ground conductor and first and second signal conductors. The first input is connected to the first signal conductor of the first coupled-line coupler at a first end of the first coupled-line coupler. The second signal conductor of the first coupled-line coupler is terminated to ground at the first end of the first coupled-line coupler. The second signal conductor of the first coupled-line coupler is connected to the first output at a second end of the first coupled-line coupler. The second signal conductor of the first coupled-line coupler is connected to the first signal conductor of the third coupled-line coupler at the second end of the first coupled-line coupler and at a first end of the third coupled-line coupler. The transmission line is connected to the first signal conductor of the first coupled-line coupler at the second end of the first coupled-line coupler. The transmission line is connected to the first signal conductor of the second coupled-line coupler at a first end of the second coupled-line coupler. The first signal conductor of the second coupled-line coupler is terminated in an open circuit at a second end of the second coupled-line coupler. The second signal conductor of the second coupled-line coupler is terminated to ground at the second end of the second coupled-line coupler. The second signal conductor of the second coupled-line coupler is connected to the second output at the first end of the second coupled-line coupler. The second signal conductor of the second coupled-line coupler is connected to the second signal conductor of the third coupled-line coupler at the first ends of the second and third coupled-line couplers. The first and second signal conductors of the third coupled-line coupler are connected to each other at a second end of the third coupled-line coupler. The first and second signal conductors of the third coupled-line coupler are connected to the first and second outputs, respectively, at the first end of the third coupled-line coupler. The second input is connected to the second end of the third coupled-line coupler.

In an embodiment, a 180° hybrid coupler includes first and second inputs, first and second outputs, first, second, and third coupled-line couplers each being defined by at least one ground conductor and only first and second signal conductors, and an electrically short transmission line connected between the first coupled-line coupler and the second coupled-line coupler. The first input is connected to the first signal conductor of the first coupled-line coupler at a first end of the first coupled-line coupler. The second signal conductor of the first coupled-line coupler is terminated to ground at the first end of the first coupled-line coupler. The second signal conductor of the first coupled-line coupler is connected to the first output at a second end of the first coupled-line coupler. The second signal conductor of the first coupled-line coupler is connected to the first signal conductor of the third coupled-line coupler at the second end of the first coupled-line coupler and at a first end of the third coupled-line coupler. The transmission line is connected to the first signal conductor of the first coupled-line coupler at the second end of the first coupled-line coupler. The transmission line is connected to the first signal conductor of the second coupled-line coupler at a first end of the second coupled-line coupler. The first signal conductor of the second coupled-line coupler is terminated in an open circuit at a second end of the second coupled-line coupler. The second signal conductor of the second coupled-line coupler is terminated to ground at the second end of the second coupled-line coupler. The second signal conductor of the second coupled-line coupler is connected to the second output at the first end of the second coupled-line coupler. The second signal conductor of the second coupled-line coupler is connected to the second signal conductor of the third coupled-line coupler at the first ends of the second and third coupled-line couplers. The first and second signal conductors of the third coupled-line coupler are connected to each other at a second end of the third coupled-line coupler. The first and second signal conductors of the third coupled-line coupler are connected to the first and second outputs, respectively, at the first end of the third coupled-line coupler. The second input is connected to the second end of the third coupled-line coupler.

In an embodiment, a feed network is provided for an antenna. The feed network includes first and second feed network input ports, first, second, third, and fourth feed ports for connection to four corresponding feed points of at least one antenna, and first, second, third, and fourth 180° hybrid couplers operatively connected between the feed network input ports and the feed ports. Each of the first, second, third, and fourth 180° hybrid couplers includes first and second inputs, first and second outputs, first, second, and third coupled-line couplers, and a transmission line connected between the first coupled-line coupler and the second coupled-line coupler. The first coupled-line coupler is connected between the first input and the first output and between the first input and the transmission line. The second coupled-line coupler is connected between the transmission line and the second output. The third coupled-line coupler is connected between the second input and the first and second outputs. The first feed network input port is connected to the first input of the first 180° hybrid coupler. The second input of the first 180° hybrid coupler is terminated in a matched load or another input port. The first output of the first 180° hybrid coupler is connected to the second input of the second 180° hybrid coupler. The second output of the second 180° hybrid coupler is connected to the second input of the third 180° hybrid coupler. The first and second outputs of the second 180° hybrid coupler are connected to the first and second feed ports, respectively. The first and second outputs of the third 180° hybrid coupler are connected to the third and fourth feed ports, respectively. The first input of the second 180° hybrid coupler is connected to the first output of the fourth 180° hybrid coupler. The first input of the third 180° hybrid coupler is connected to the second output of the fourth 180° hybrid coupler. The first input of the fourth 180° hybrid coupler is terminated in a matched load or another input port. The second feed network input port is connected to the second input of the fourth 180° hybrid coupler.

DETAILED DESCRIPTION

Figure 1:
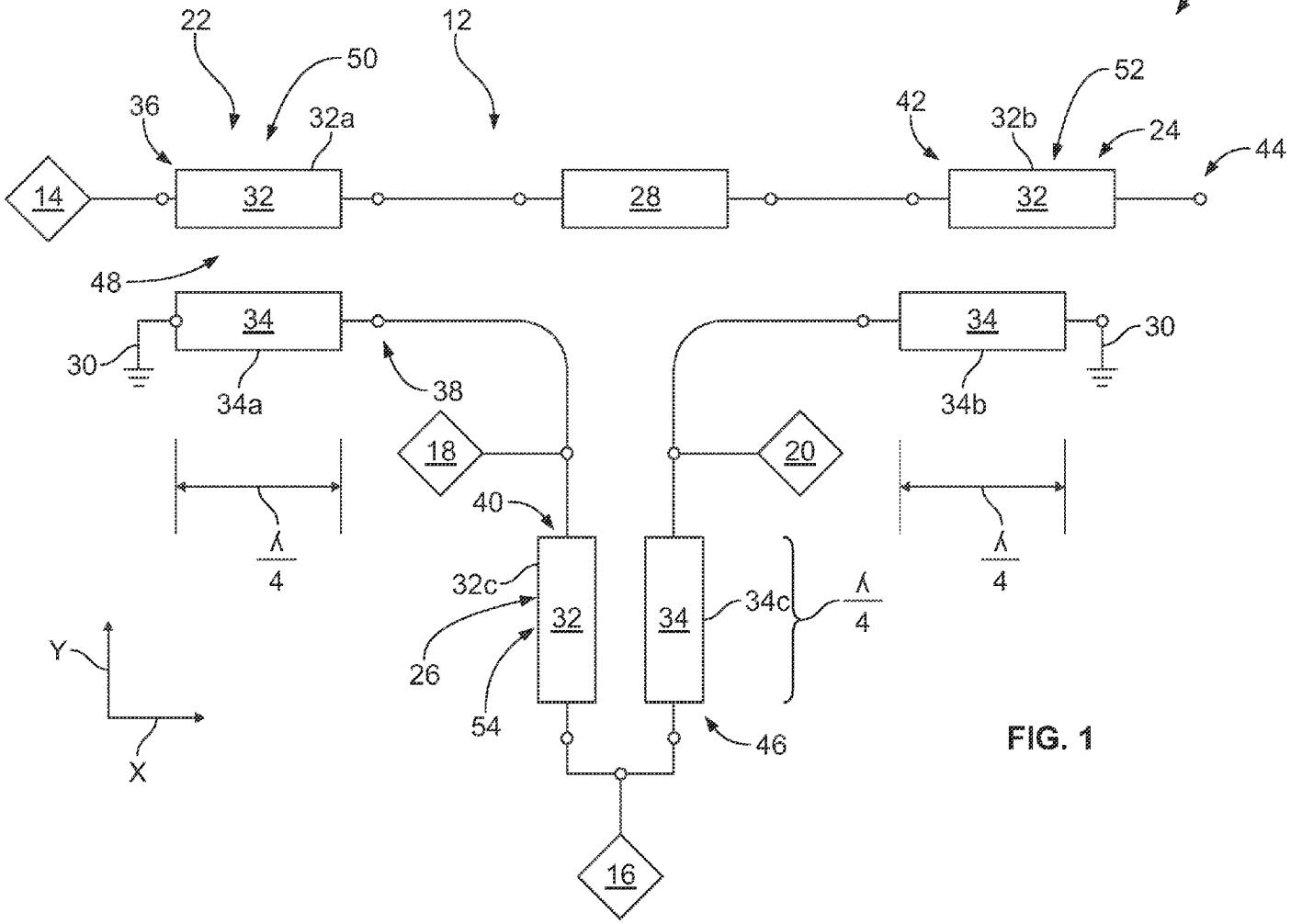
FIG. 1 is a schematic view of an embodiment of a 180° coupled-line hybrid coupler.

FIG. 1 is a schematic view of an embodiment of a 180° coupled-line hybrid coupler 10. The 180° hybrid coupler 10 includes a circuit 12 having two inputs 14 and 16 and two outputs 18 and 20. The circuit 12 includes three coupled-line couplers 22, 24, and 26 connected between the inputs 14 and 16 and the outputs 18 and 20. The circuit 12 also includes a transmission line 28 directly connected between two of the three coupled-line couplers 22, 24, and 26. As will be described below, each of the three coupled-line couplers 22, 24, and 26 is defined by one or more ground conductors 30 and only two signal conductors 32 and 34. Moreover, and as will be described below, the transmission line 28 may have an electrically short (i.e., small) length. In some embodiments, the transmission line 28 has an electrical length of zero.

The inputs 14 and 16 will be referred to herein as first and second inputs 14 and 16, respectively. The outputs 18 and 20 will be referred to herein as first and second outputs 18 and 20, respectively. The coupled-line couplers 22, 24, and 26 will be referred to herein as first, second, and third coupled-line couplers 22, 24, and 26, respectively. The 180° coupled-line hybrid coupler 10 may be referred to herein as a "first", a "second", a "third", and/or a "fourth" 180° coupled-line hybrid coupler.

As shown in FIG. 1, the first coupled-line coupler 22 is connected between the first input 14 and the first output 18. Specifically, the first input 14 is connected to a first signal conductor 32*a* of the first coupled-line coupler 22 at a first end 36 of the first coupled-line coupler 22, and a second signal conductor 34*a* of the first coupled-line coupler 22 is connected to the first output 18 at a second end 38 of the first coupled-line coupler 22. The first coupled-line coupler 22 is also connected between the first input 14 and the third coupled-line coupler 26. Specifically, the second signal conductor 34*a* of the first coupled-line coupler 24 is connected to a first signal conductor 32*c* of the third coupled-line coupler 26 at the second end 38 of the first coupled-line coupler 22 and at a first end 40 of the third coupled-line coupler 26. The second signal conductor 34*a* of the first coupled-line coupler 22 is terminated to a ground conductor 30 at the first end 36 of the first coupled-line coupler 22, as is shown in FIG. 1.

The first coupled-line coupler 22 is also connected between the first input 14 and the transmission line 28. Specifically, the transmission line 28 is connected to the first signal conductor 32*a* of the first coupled-line coupler 22 at the second end 38 of the first coupled-line coupler 22.

The transmission line 28 is connected between the first and second coupled-line couplers 22 and 24, respectively. Moreover, the second coupled-line coupler 24 is connected between the transmission line 28 and the second output 20. Specifically, the transmission line 28 is connected to a first signal conductor 32*b* of the second coupled-line coupler 24 at a first end 42 of the second coupled-line coupler 24, and a second signal conductor 34*b* of the second coupled-line coupler 24 is connected to the second output 20 at the first end 42 of the second coupled-line coupler 24. The second coupled-line coupler 24 is also connected between the transmission line 28 and the third coupled-line coupler 26. Specifically, the second signal conductor 34*b* of the second coupled-line coupler 24 is connected to a second signal conductor 34*c* of the third coupled-line coupler 26 at the first ends 42 and 40 of the second and third coupled-line couplers 24 and 26, respectively. As shown in FIG. 1, the first signal conductor 32*b* of the second coupled-line coupler 24 is terminated in an open circuit at a second end 44 of the second coupled-line coupler 24. The second signal conductor 34*b* of the second coupled-line coupler 24 is terminated to a ground conductor 30 at the second end 44 of the second coupled-line coupler 24, as can be seen in FIG. 1.

The first and second signal conductors 32*c* and 34*c*, respectively, of the third coupled-line coupler 26 are connected to each other at a second end 46 of the third coupled-line coupler 26. The third coupled-line coupler 26 is connected between the second input 16 and the first and second outputs 18 and 20, respectively. Specifically, the second input 16 is connected to the second end 46 of the third coupled-line coupler 26. The first and second signal conductors 32*c* and 34*c*, respectively, of the third coupled-line coupler 26 are connected to the first and second outputs 14 and 16, respectively, at the first end 40 of the third coupled-line coupler.

At least one of the three coupled-line couplers 22, 24, and 26 is defined by the one or more ground conductors 30 and only two signal conductors 32 and 34. In other words, the coupled-line coupler 22, 24, and/or 26 does not include any other signal conductors in addition to the signal conductors 32 and 34. For example, while the first coupled-line coupler 22 includes the signal conductor 34*a* on a side 48 of the signal conductor 32*a*, the first coupled-line coupler 22 does not include (i.e., is not defined at all by) another signal conductor (not shown) that extends along an opposite side 50 of the signal conductor 32*a*. In the exemplary embodiment, each of the first, second, and third coupled-line couplers 22, 24, and 26, respectively, is defined by only two signal conductors 32 and 34. Accordingly, in the illustrated embodiment, the second coupled-line coupler 24 does not include (i.e., is not defined at all by) another signal conductor (not shown) that extends along a side 52 of the signal conductor 32*b*, and the third coupled-line coupler 26 does not include (i.e., is not defined at all by) another signal conductor (not shown) that extends along a side 54 of the signal conductor 32*c*.

In operation, the 180° hybrid coupler 10 is a four-port circuit that combines two input signals. Specifically, assuming matched conditions, a signal applied at the first input 14 appears in series across the outputs 18 and 20, with little or no energy appearing at (i.e., little or no electrical power output from) the second input 18 because the second input 18 is isolated. When the signal is applied at the first input 14, the circuit 12 of the 180° hybrid coupler 10 divides the signal into two signals at the outputs 18 and 20 that have approximately equal amplitudes and are separated by a phase difference of 180° (i.e., have opposite phase). A signal applied at the second input 16 appears in parallel across the outputs 18 and 20. The first input 14 is isolated such that little or no energy appears at (i.e., little or no electrical power is output from) the first input 14 when the signal is applied at the second input 16. When the signal is applied at the second input 16, the circuit 12 of the 180° hybrid coupler 10 divides the signal into two signals at the outputs 18 and 20 that have approximately equal amplitudes and have approximately the same phase. For example, when a signal is applied at the first input 14, the circuit 12 of the 180° hybrid coupler 10 divides the signal into a first signal at the first output 18 that has a phase of 0° and a second signal at the second output 20 that has a phase of approximately 180° relative to the phase of the first signal at the first output 18; and when a signal is applied at the second input 16, the circuit 12 of the 180° hybrid coupler 10 divides the signal into a first signal at the first output 18 that has a phase of 0° and a second signal at the second output 20 that also has a phase of 0° relative to the phase of the first signal at the first output 18.

In the exemplary embodiment, the each of the coupled-line couplers 22, 24, and 26 includes only a single quarter wavelength element (i.e., coupling section), as is shown in FIG. 1. In other embodiments, the coupled-line coupler 22, 24, and/or 26 includes an odd number of single quarter wavelength elements (e.g., three quarter wavelength elements that are arranged back-to-back in tandem and/or the like).

The 180° hybrid coupler 10 may have any characteristic impedance, such as, but not limited to, approximately 70.7 Ohms, approximately 50 Ohms, and/or the like. In some embodiments, the 180° hybrid coupler 10 has a characteristic impedance that is different than a characteristic impedance of the first input 14, the second input 16, the first output 18, and/or the second output 20. For example, the 180° hybrid coupler 10 may have a characteristic impedance of approximately 70.7 Ohms, while the inputs 14 and 16 and the outputs 18 and 20 may each have a characteristic impedance of approximately 50 Ohms.

The 180° coupled-line hybrid coupler 10 may operate at any frequencies. Examples of the operating frequencies of the 180° coupled-line hybrid coupler 10 include, but are not limited to, frequencies above approximately 0.50 GHz, frequencies of at least approximately 1.00 GHz, frequencies of at least approximately 1.50 GHz, frequencies above approximately 3.00 GHz, frequencies below approximately 3.00 GHz, frequencies below approximately 2.00 GHz, frequencies between approximately 1.00 GHz and 2.00

GHz, and/or the like. The 180° hybrid coupler 10 may operate over a frequency band having any bandwidth. Examples of the bandwidth of the operational frequency band of the 180° hybrid coupler 10 include, but are not limited to, approximately 200 MHz, approximately 400 MHz, approximately 500 MHz, approximately 600 MHz, and/or the like. The 180° hybrid coupler 10 may operate at higher frequencies as compared to at least some known 180° hybrid couplers. For example, some known 180° hybrid couplers may not operate above approximately 1.00 GHz. The 180° hybrid coupler 10 may have an increased bandwidth as compared to at least some known 180° hybrid couplers. For example, some known 180° hybrid couplers have a bandwidth of up to only approximately 100 MHz.

Various parameters of the 180° hybrid coupler 10 may be selected to provide the 180° hybrid coupler 10 with predetermined operating frequencies and/or with a predetermined bandwidth, for example to provide increased bandwidth and/or operation at higher operating frequencies as compared to at least some known 180° hybrid couplers. For example, the characteristic impedance value of the 180° hybrid coupler 10, the thickness and/or dielectric constant of a bonding layer and/or substrate (e.g., the thickness T and/or dielectric constant of the bonding layer 108 shown in FIGS. 3 and 4 and/or the thickness and/or dielectric constant of the substrate 314 shown in FIG. 5), and/or the like may be selected to provide the 180° hybrid coupler 10 with predetermined operating frequencies and/or with a predetermined bandwidth. In one specific example, the use of more than one quarter wavelength coupling element may increase the bandwidth of the 180° hybrid coupler 10 and/or may configure the 180° hybrid coupler 10 to operate at higher frequencies.

The 180° hybrid coupler 10 may have any size. For example, the overall x dimension of the 180° hybrid coupler 10 and the overall y dimension of the 180° hybrid coupler 10 may each have any value. Examples of the values of each of the overall x dimension and the overall y dimension of the 180° hybrid coupler 10 include, but are not limited to, less than approximately 1.0 inches, less than approximately 0.5 inches, less than approximately 0.25 inches, between approximately 0.10 inches and approximately 1.0 inches, and/or the like. It should be understood that the exemplary dimensions described herein of the 180° hybrid coupler 10 are applicable to a 180° hybrid coupler 10 having any shape in the x and y dimensions. The 180° hybrid coupler 10 may be smaller than at least some known 180° hybrid couplers. For example, at least some known 180° hybrid couplers have x and/or y dimensions that are at least 1.0 inches. The 180° hybrid coupler 10 may be easier, less costly, and/or the like to manufacture as compared to at least some known 180° hybrid couplers.

Various parameters of the 180° hybrid coupler 10 may be selected to provide the 180° hybrid coupler 10 with a predetermined size, for example with predetermined values for the x and y dimensions. In one specific example, a characteristic impedance of 70.7 Ohms enables the maximum coupling of the 180° hybrid coupler 10 to exceed that otherwise possible, which accomplishes an approximately 3 dB power division with only single quarter wavelength elements. The use of only a single quarter wavelength coupling element within the coupled-line couplers 22, 24, and/or 26, as opposed to more than one quarter wavelength element arranged back-to-back in tandem, may reduce the size of the 180° hybrid coupler 10.

Figure 2:
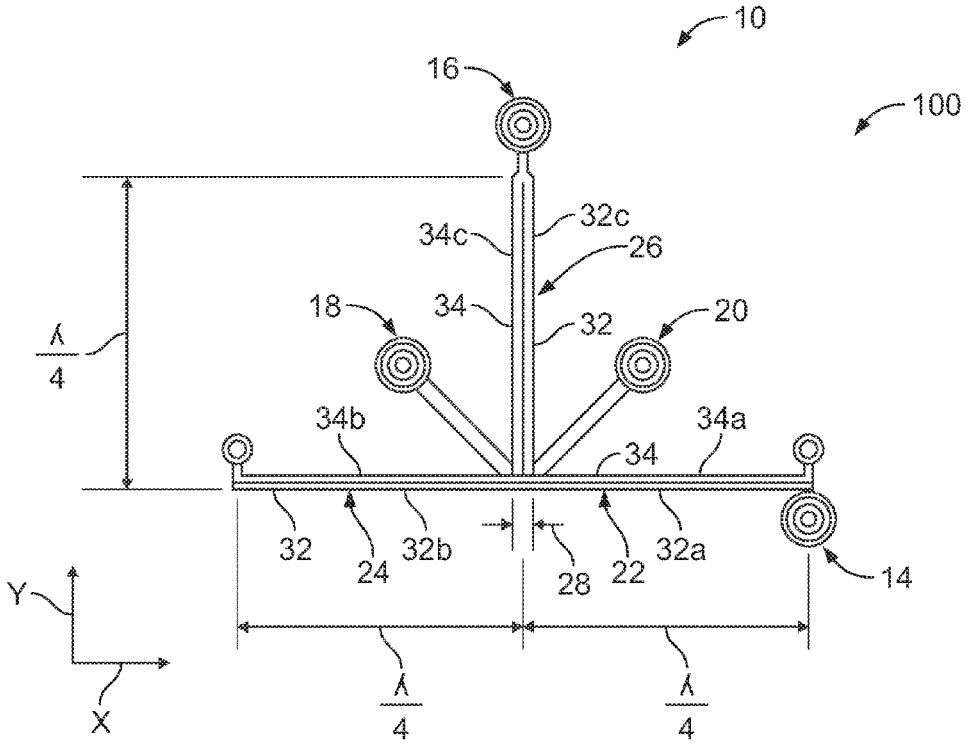
FIG. 2 is a plan view of a stripline embodiment of the 180° hybrid coupler shown in FIG. 1.
Figure 3:
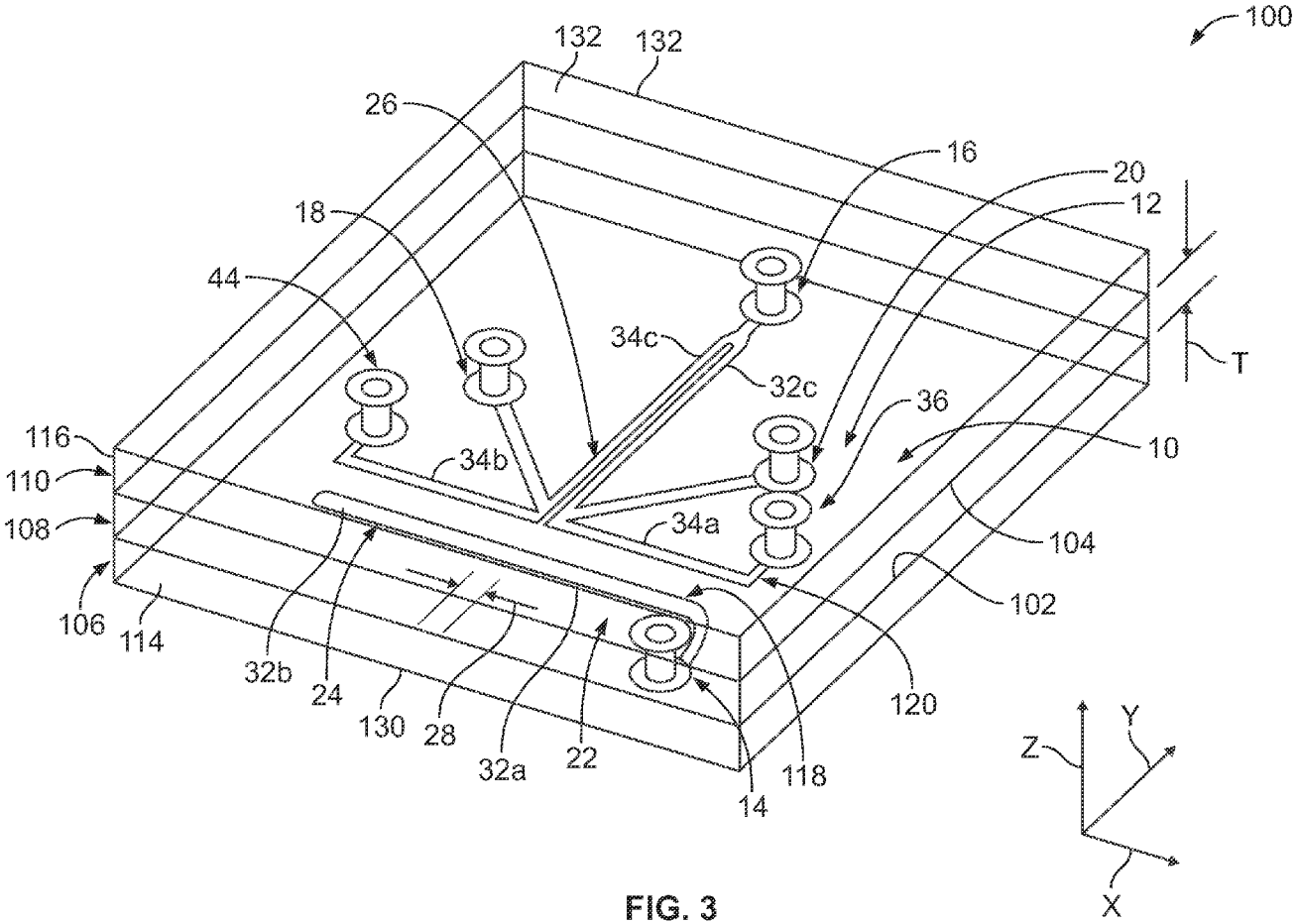
FIG. 3 is a perspective view of an embodiment of a printed circuit that defines the stripline embodiment of the 180° hybrid coupler shown in FIG. 2.

FIG. 2 is a plan view of a stripline embodiment of the 180° hybrid coupler 10. FIG. 3 is a perspective view of an embodiment of a printed circuit 100 that defines the stripline embodiment of the 180° hybrid coupler 10. Referring now to FIGS. 2 and 3, the printed circuit 100 includes the first and second inputs 14 and 16, respectively, the first and second outputs 18 and 20, respectively, the transmission line 28, and the first, second, and third coupled-line couplers 22, 24, and 26, respectively. The 180° hybrid coupler 10 is not limited to the configuration shown in FIGS. 2 and 3. For example, the 180° hybrid coupler 10 is not limited to the printed circuit 100 nor the physical arrangement (e.g., location and/or the like) of various elements of the 180° hybrid coupler 10 along the printed circuit 100 that is shown in FIGS. 2 and 3. Rather, the configuration of the 180° hybrid coupler 10 shown in FIGS. 2 and 3 is meant as exemplary only. Other configurations may be used. For example, the 180° hybrid coupler 10 may not be implemented on a printed circuit and/or the various elements of the 180° hybrid coupler 10 may have a different physical arrangement along the printed circuit 100 (e.g., see the 180° coupled-line hybrid coupler 210 shown in FIG. 5).

Figure 4:
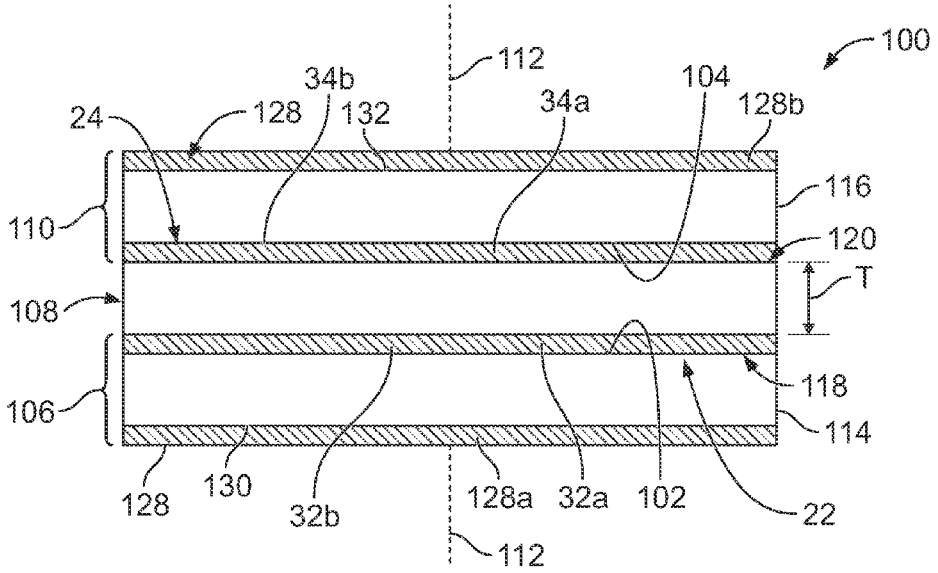
FIG. 4 is a cross-sectional view of the printed circuit shown in FIG. 3.

As shown in FIG. 3 (and will also be apparent in FIG. 4), the embodiment of the 180° hybrid coupler 10 of FIGS. 2-4 illustrates an embodiment wherein the first signal conductors 32*a* and 32*b* of the first and second coupled-line couplers 22 and 24, respectively, are located on different surfaces 102 and 104, respectively, of the printed circuit 100, as will be described below.

FIG. 4 is a cross-sectional view of the printed circuit 100. Referring now to FIGS. 3 and 4, the printed circuit 100 includes a circuit element layer 106, a dielectric bonding layer 108, and a circuit element layer 110 arranged in a stack with the bonding layer 108 extending between the circuit element layers 106 and 110. The bonding layer 108 extends a thickness T along a central axis 112 (not shown in FIG. 3) of the printed circuit 100. The circuit element layers 106 and 110 are spaced apart from each other by a gap that is defined by the thickness T of the bonding layer 108.

Each of the circuit element layers 106 and 110 includes a respective dielectric substrate 114 and 116 and a respective circuit element sub-layer 118 and 120 extending on a respective surface 102 and 104 of the substrate 114 and 116, respectively. As can be seen in FIGS. 3 and 4, the surfaces 102 and 104 oppose (i.e., face) each other. The circuit element sub-layer 120 of the circuit element layer 110 includes the second signal conductors 34*a* and 34*b* of the first and second coupled-line couplers 22 and 24, respectively, and (although not visible in FIG. 4) also includes the first and second signal conductors 32*c* and 34*c*, respectively, of the third coupled-line coupler 26 (not visible in FIG. 4). The circuit element sub-layer 118 of the circuit element layer 106 includes the first signal conductors 32*a* and 32*b* of the first and second coupled-line couplers 22 and 24, respectively. The first signal conductors 32*a* and 32*b* are thus spaced apart from the respective second signal conductors 34*a* and 34*b* by the thickness T of the bonding layer 108. Each of the surfaces 102 and 104 may be referred to herein as a "first" and/or a "second" surface of the printed circuit 100.

The printed circuit 100 includes one or more electrically conductive ground plane layers 128 (not shown in FIG. 3). In the exemplary embodiment, the printed circuit 100 includes two ground plane layers 128*a* and 128*b*. The ground plane layer 128*a* extends on a surface 130 of the substrate 114 that is opposite the surface 102. The ground plane layer 128*b* extends on a surface 132 of the substrate 116 that is opposite the surface 104. Although two are shown, the printed circuit 100 may include any number of ground plane layers 128, each of which may be an external layer (as is shown in FIG. 4) or an internal layer of the printed circuit 100. Moreover, although the printed circuit 100 is shown and described herein as having five layers, the printed circuit 100 may include any number of layers. Although the printed circuit 100 is shown and described herein as having three dielectric layers, the printed circuit 100 may include any number of dielectric layers. The printed circuit 100 may include any number of circuit element layers. The ground plane layers 128*a* and/or 128*b* may define all or a portion of a ground conductor 30 (shown in FIG. 1).

The ground plane layers 128*a* and 128*b* may each include one or more openings, vias, and/or other structures (not shown) that enable electrical and/or other connections to be made to the printed circuit 100, for example at the inputs 14 and/or 16 (not visible in FIG. 4), the outputs 18 and/or 20 (not visible in FIG. 4), and/or the like. The ground plane layers 128*a* and 128*b* are each electrically conductive and may each be fabricated from any electrically conductive material, such as, but not limited to, copper, gold, silver, aluminum, tin, and/or the like.

The bonding layer 108 may include one or more openings, vias, and/or other structures (not visible in FIG. 4 and not labeled with a reference numeral in FIG. 3) that enable electrical and/or other connections to be made to the printed circuit 100, between various elements of the circuit elements layers 106 and 110, and/or between the ground plane layers 128*a* and 128*b*. The bonding layer 108 may have any dielectric constant. Examples of suitable materials for the bonding layer 108 include, but are not limited to, air, ceramic, rubber, fluoropolymer, composite material, fiberglass, plastic, and/or the like.

Referring again solely to FIG. 3, the ground plane layers 128*a* and 128*b* have been removed from the 180° hybrid coupler 10 in FIG. 3 for clarity. Each of the second signal conductors 34*a* and 34*b* of the first and second coupled-line couplers 22 and 24, respectively, is shorted to the ground plane layer 128*a* and/or the ground plane layer 128*b* at the respective end 36 and 44 thereof.

The first signal conductors 32*a* and 32*b* are spaced apart from the second signal conductors 34*a* and 34*b*, respectively, by the gap provided by the thickness T of the bonding layer 108 such that the first signal conductors 32*a* and 32*b* are offset-coupled with the respective second signal conductors 34*a* and 34*b* across the gap in an offset-coupled stripline topology. In the exemplary embodiment of the printed circuit 100, the first signal conductors 32*a* and 32*b* are offset (i.e., staggered) along the y-axis relative to the respective second signal conductors 34*a* and 34*b*. Alternatively, the first signal conductor 32*a* and/or 32*b* is aligned along the y-axis with the respective second signal conductor 34*a* and/or 34*b*.

The first signal conductors 32*a* and 32*b* are not limited to being offset-coupled with the second signal conductors 34*a* and 34*b*, respectively, across the gap provided by the thickness T of the bonding layer 108. Rather, and for example, the 180° hybrid coupler 10 may be implemented on a printed circuit using a microstrip line topology, wherein the first signal conductors 32*a* and 32*b* extend on the same surface of the printed circuit as the respective second signal conductors 34*a* and 34*b* such that the first signal conductors 32*a* and 32*b* are edge-coupled with the respective second signal conductors 34*a* and 34*b*.

Figure 5:
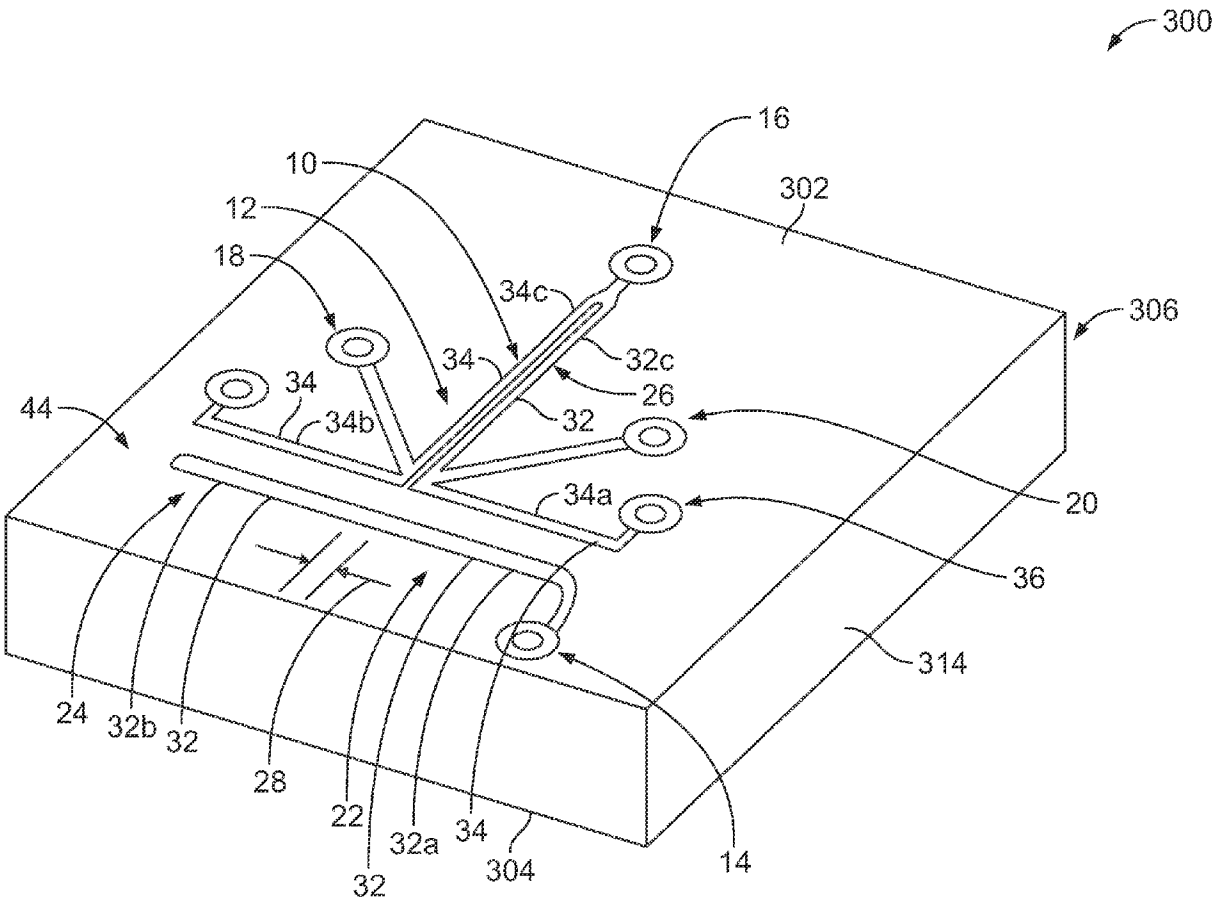
FIG. 5 is a perspective view of a microstrip embodiment of the 180° hybrid coupler shown in FIG. 1.

For example, FIG. 5 is a perspective view of an embodiment of a printed circuit 100 that defines microstrip embodiment of the 180° hybrid coupler 10. The printed circuit 300 includes the first and second inputs 14 and 16, respectively, the first and second outputs 18 and 20, respectively, the transmission line 28, and the first, second, and third coupled-line couplers 22, 24, and 26, respectively. The printed circuit 300 also includes a circuit element layer 306 that includes a dielectric substrate 314 having opposite surfaces 302 and 304. The printed circuit 300 includes one or more electrically conductive ground plane layers (not shown), for example a ground plane layer extending on the surface 304 of the dielectric substrate 314, an internal ground plane layer, and/or the like. The second signal conductors 34*a* and 34*b* of the first and second coupled-line couplers 22 and 24, respectively, are shorted to the ground plane layer(s) at the respective end 36 and 44 thereof. The printed circuit 300 may include any number of layers overall, any number of ground plane layers, any number of circuit element layers, and any number of dielectric layers.

As can be seen in FIG. 5, the embodiment of the 180° hybrid coupler 10 of FIG. 5 illustrates an embodiment wherein the first and second signal conductors 32 and 34 of each of the first, second, and third coupled-line coupling elements 22, 24, and 26, respectively, are located on the same surface of the printed circuit as each other such that the first signal conductors 32 are edge-coupled with the corresponding second signal conductors 34. For example, the first signal conductors 32*a* and 32*b* and the second signal conductors 34*a* and 34*b* of the respective first and second coupled-line couplers 22 and 24 extend on the same surface 302 of the substrate 314 such that the first signal conductors 32*a* and 32*b* are edge-coupled with the respective second signal conductors 34*a* and 34*b* along the surface 302.

Although the surface 302 of the dielectric substrate 314 is an exterior surface of the printed circuit 300 in the exemplary embodiment of FIG. 5, the surface 302 on which the first and second signal conductors 32 and 34, respectively, extend may alternatively be an internal surface of the printed circuit 300.

Figure 6:
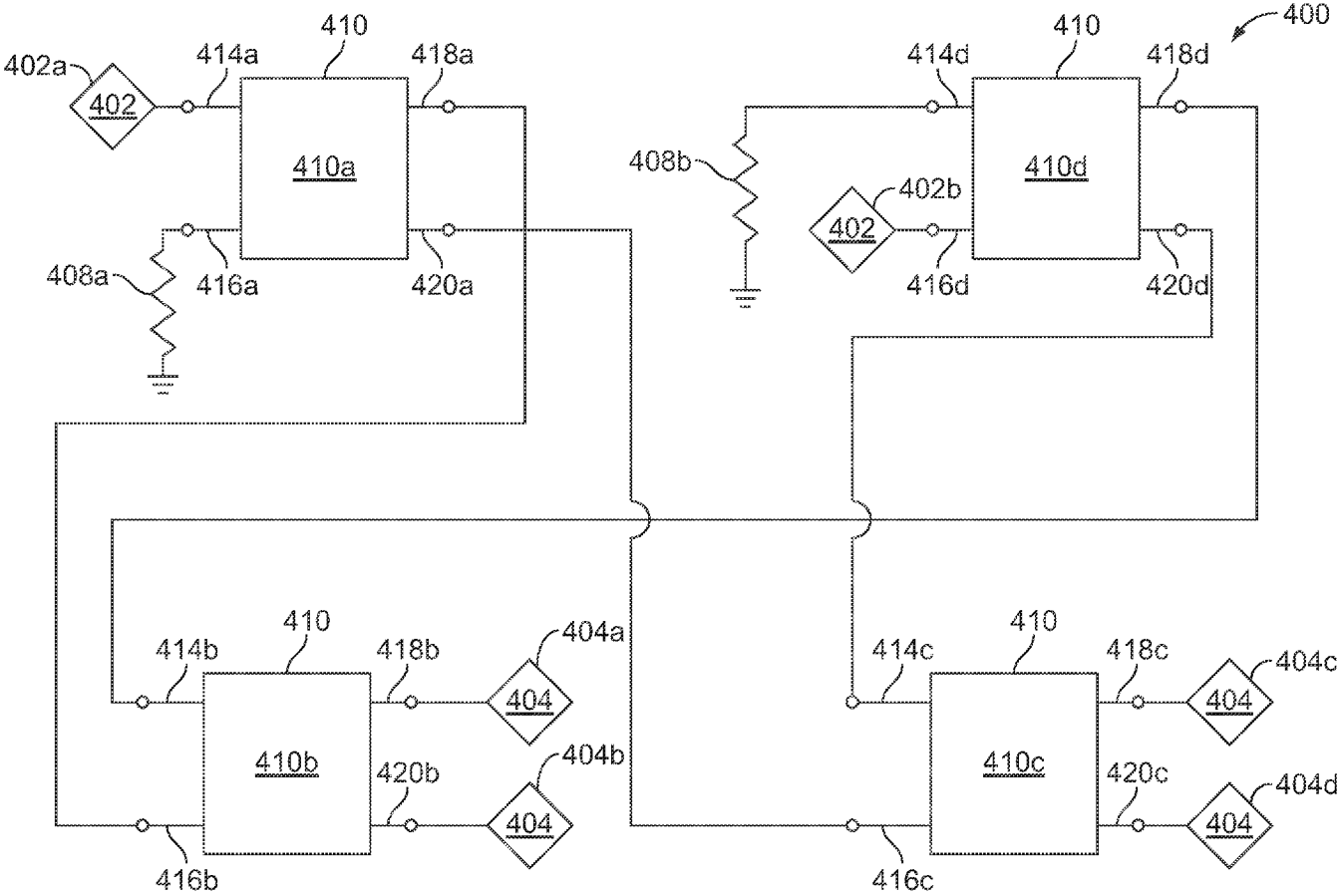
FIG. 6 is a schematic view of an embodiment of a feed network for an antenna.
Figure 7:
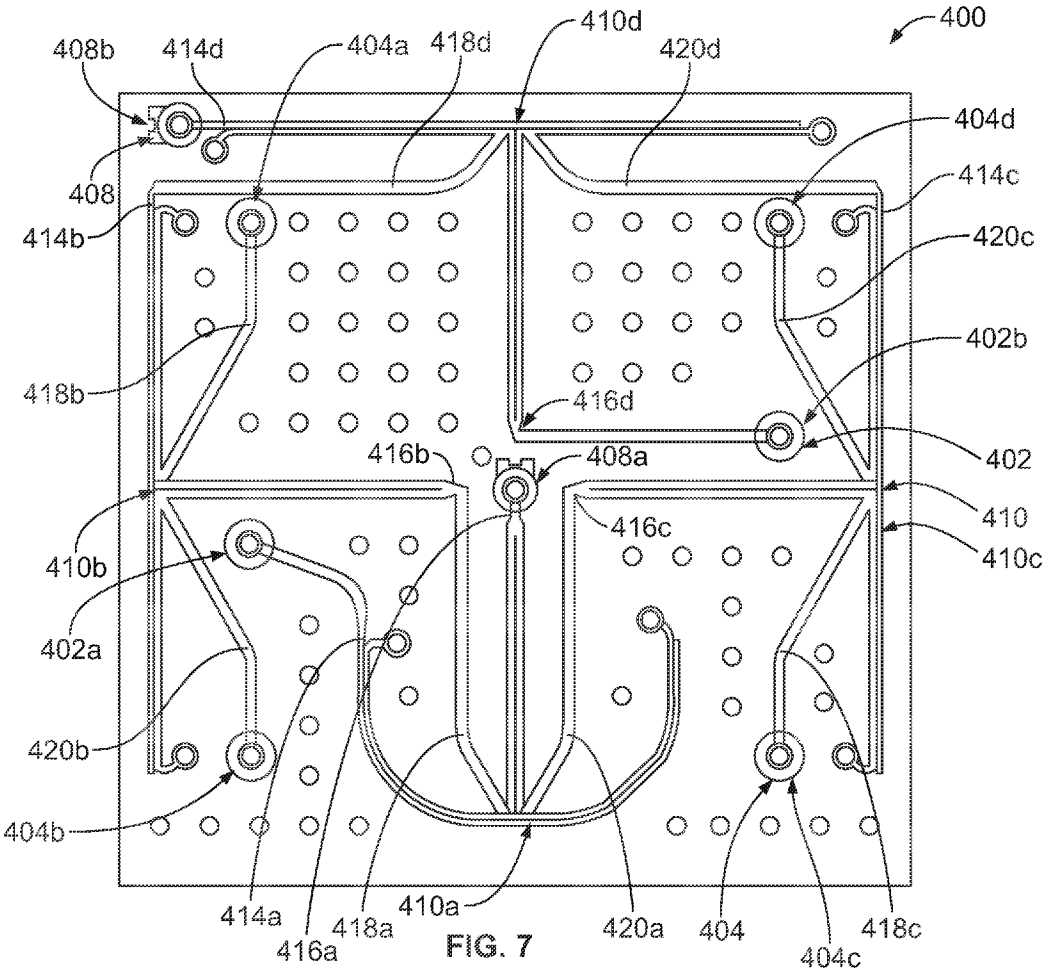
FIG. 7 is a plan view of a stripline embodiment of the feed network shown in FIG. 6.

Two or more of the 180° hybrid couplers 10 (shown in FIGS. 1-5) may be combined to create a four-port feed network for dual-linearly polarized antenna applications. For example, FIG. 6 is a schematic view of an embodiment of a feed network 400 for an antenna (not shown). FIG. 7 is a plan view of a stripline embodiment of the feed network 400; and FIG. 8 is a perspective view of an embodiment of a printed circuit 500 that defines the stripline embodiment of the feed network 400.

Figure 8:
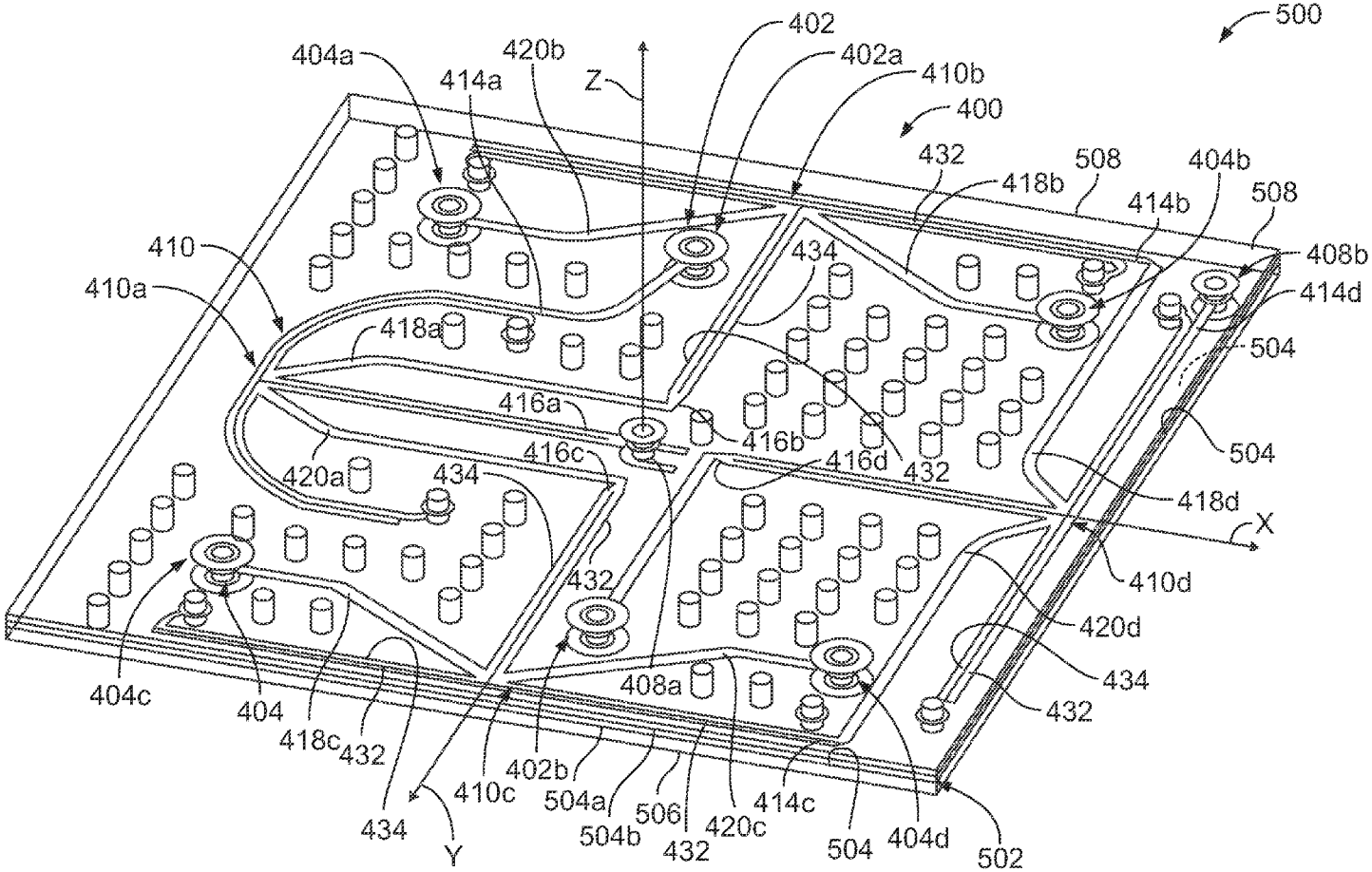
FIG. 8 is a perspective view of an embodiment of a printed circuit that defines the stripline embodiment of the feed network shown in FIGS. 6 and 7.

Referring to FIGS. 6-8, the feed network 400 includes two input ports 402, four feed ports 404, and four 180° hybrid couplers 410. The two input ports 402 are labeled as input ports 402*a* and 402*b*. The four feed ports 404 are labeled as feed ports 404*a*, 404*b*, 404*c*, and 404*d*. The four 180° hybrid couplers 410 are labeled as 180° hybrid couplers 410*a*, 410*b*, 410*c*, and 410*d*. Outputs 418*b* and 420*b* of the 180° hybrid coupler 410*b* define the feed ports 404*a* and 404*b*, respectively. Outputs 418*c* and 420*c* of the 180° hybrid coupler 410*c* define the feed ports 404*c* and 404*d*, respectively.

Each of the input ports 402*a* and 402*b* may be referred to herein as a "first" and/or a "second" input port. Each of the feed ports 404*a*, 404*b*, 404*c*, and 404*d* may be referred to herein as a "first", "second", "third", and/or "fourth" feed port. Each of the 180° hybrid couplers 410*a*, 410*b*, 410*c*, and 410*d* may be referred to herein as a "first", "second", "third", and/or "fourth" 180° coupled-line hybrid coupler. The feed network 400 may include any number of each of the components 402, 404, 408 (described below), and 410 that enables the feed network 400 to function as described and/or illustrated herein.

The input port 402*a* is connected to receive and/or transmit electronics (not shown) of a corresponding antenna (not shown) for delivering RF waves from the corresponding antenna to the receive and/or transmit electronics and/or for feeding RF signals from the receive and/or transmit electronics to the corresponding antenna as RF waves. The input port 402*b* is also connected to the receive and/or transmit electronics for delivering RF waves from the corresponding antenna to the receive and/or transmit electronics as RF signals and/or for feeding RF signals from the receive and/or transmit electronics to the corresponding antenna as RF waves. Each of the feed ports 404 is connected to a corresponding feed point (not shown) of the corresponding antenna for feeding the corresponding antenna with RF energy at the corresponding feed point. For example, the feed ports 404 may be connected to corresponding feed probes (not shown) that are provided at the feed points of the corresponding antenna. In the exemplary embodiment of the feed network 400, the feed network 400 includes four feed ports 404 such that the feed network 400 is configured to feed the corresponding antenna at the four corresponding feed points of the corresponding antenna.

Referring now solely to FIG. 8, the exemplary embodiment of the feed network 400 is implemented on the printed circuit 500 (but is not limited thereto). The printed circuit 500 includes a dielectric substrate 502 having one or more internal layer surfaces 504. Optionally, the printed circuit 500 includes one or more electrically conductive ground plane layers (not shown), for example a ground plane layer extending on a surface 506 of the dielectric substrate 502, an internal ground plane layer, a ground plane layer extending on a surface 508 of the dielectric substrate 502, and/or the like. Segments of electrical traces of one or more of the 180° hybrid couplers 410 may be shorted to the ground plane layer(s). The printed circuit 500 may include any number of layers overall, any number of dielectric layers, any number of circuit element layers, and any number of ground plane layers.

In the exemplary embodiment of the feed network 400, some first signal conductors 432 of the four 180° hybrid couplers 410 are located on different surfaces 504*a* and 504*b* of the printed circuit 400 than the corresponding second signal conductors 434 (i.e., offset-coupled with each other in a stripline topology). Although the surfaces 504*a* and 504*b* of the dielectric substrate 502 are internal surfaces of the printed circuit 500, the surface 504*a* and/or 504*b* may alternatively be an exterior surface of the printed circuit 500. Moreover, the first and second signal conductors 432 and 434, respectively, are optionally spread over more than two surfaces of the printed circuit 500. In some other embodiments, the first and second signal conductors 432 and 434, respectively, of the 180° hybrid couplers 410 are formed on the same surface of the printed circuit 500 as each other (e.g., edge-coupled in a microstrip topology). Other configurations may be used in other embodiments.

Referring again to FIGS. 6-8, the four 180° hybrid couplers 410 are operatively connected between the input port 402*a* and the four feed ports 404 for feeding RF energy between the input port 402*a* and the four feed probes. In the exemplary embodiment, the four 180° hybrid couplers 410 are also operatively connected between the input port 402*b* and the four feed ports 404 for feeding RF energy between the input port 402*b* and the four feed probes. As will be described below, changing which input port 402*a* or 402*b* is used electrically switches the feed network 400 between feeding the corresponding antenna in different directions.

The input port 402*a* drives the outputs 418*b*, 420*b*, 418*c*, and 420*c* of the respective 180° hybrid couplers 410*b* and 410*c*, and thus the respective feed ports 404*a*, 404*b*, 404*c*, and 404*d*, through the 180° hybrid coupler 410*a*. Specifically, the 180° coupled-line hybrid coupler 410*a* is operatively connected between the input port 402*a* and the 180° hybrid couplers 410*b* and 410*c*. More specifically, an input 414*a* of the 180° hybrid coupler 410*a* is connected to the input port 402*a*. The other input 416*a* of the 180° hybrid coupler 410*a* is connected to a discrete resistor 408*a*. Outputs 418*a* and 420*a* of the 180° hybrid coupler 410*a* are connected to respective inputs 416*b* and 416*c* of the 180° hybrid couplers 410*b* and 410*c*, respectively.

The input port 402*b* drives the outputs 418*b*, 420*b*, 418*c*, and 420*c* of the respective 180° hybrid couplers 410*b* and 410*c* (and thus the respective feed ports 404*a*, 404*b*, 404*c*, and 404*d*) through the 180° hybrid coupler 410*d*. The 180° hybrid coupler 410*d* is operatively connected between the input port 402*b* and the 180° hybrid couplers 410*b* and 410*c*. Specifically, an input 416*d* of the 180° hybrid coupler 410*d* is connected to the input port 402*b*, while the other input 414*d* of the 180° hybrid coupler 410*d* is connected to a discrete resistor 408*b*. Outputs 418*d* and 420*d* of the 180° hybrid coupler 410*d* are connected to respective inputs 414*b* and 414*c* of the 180° hybrid couplers 410*b* and 410*c*, respectively.

As should be appreciated from the above description and FIGS. 6-8, the four 180° hybrid couplers 410 are electrically arranged relative to the input ports 402*a* and 402*b* and the four feed ports 404 such that the four feed ports 404 are configured to feed the corresponding antenna at the four corresponding feed points of the antenna: (1) with approximately equal amplitude; (2) with a first pair of the four feed ports 404 having a first phase; and (3) with a second pair of the four feed ports 404 having a second phase that is opposite the first phase.

Specifically, when the feed network 400 feeds the corresponding antenna using the input port 402*a*, the 180° hybrid coupler 410*a* is fed through the input 414*a* and thus the signals output at the outputs 418*a* and 418*b* of the 180° hybrid coupler 410*a* have opposite phases. The 180° hybrid coupler 410*b* receives the signal from the output 418*a* of the 180° hybrid coupler 410*a* through the input 416*b* of the 180° hybrid coupler 410*b*, which provides the signals at the outputs 418*b* and 420*b*, and thus at the respective feed ports 404*a* and 404*b*, with the same first phase. The 180° hybrid coupler 410*c* receives the signal from the output 420*a* of the 180° hybrid coupler 410*a* through the input 416*c* of the 180° hybrid coupler 410*c*, which provides the signals at the outputs 418*c* and 420*c*, and thus at the respective feed ports 404*c* and 404*d*, with the same second phase. It should be appreciated that the first and second phases are opposite each other because the outputs 418*a* and 420*a* of the 180° hybrid coupler 410*a* have opposite phase. For example, when the feed network 400 feeds the corresponding antenna using the input port 402*a*, the 180° hybrid couplers 410*a* and 410*b* may cooperate to provide the feed ports 404*a* and 404*b* with a phase of 00, while the 180° hybrid couplers 410*a* and 410*c* cooperate to provide the feed ports 404*c* and 404*d* with a phase of 180°.

When the feed network 400 feeds the corresponding antenna using the input port 402*b*, the 180° hybrid coupler 410*d* is fed through the input 416*d* and thus the signals output at the outputs 418*d* and 418*d* of the 180° hybrid coupler 410*d* have the same phase. The 180° hybrid coupler

410*c* receives the signal from the output 418*d* of the 180° hybrid coupler 410*d* through the input 414*c* of the 180° hybrid coupler 410*c*, which provides the signals at the outputs 420*c* and 418*c*, and thus at the respective feed ports 404*d* and 404*c*, with respective first and second phases that are opposite each other. The 180° hybrid coupler 410*b* receives the signal from the output 420*d* of the 180° hybrid coupler 410*d* through the input 414*b* of the 180° hybrid coupler 410*b*, which provides the signals at the outputs 418*b* and 420*b*, and thus at the respective feed ports 404*a* and 404*b*, with the first and second phases, respectively. For example, when the feed network 400 feeds the corresponding antenna using the input port 402*b*, the 180° hybrid couplers 410*d*, 410*b*, and 410*c* may cooperate to provide the feed ports 404*a* and 404*d* with a phase of 0° and to provide the feed ports 404*b* and 404*c* with a phase of 180°.

Accordingly, when the input port 402*a* is used, a first pair of the four feed ports 404 having the first phase is composed of the feed ports 404*a* and 404*b*, while a second pair of the four feed ports 404 having the second phase that is opposite the first phase is composed of the feed ports 404*c* and 404*d*. But, when the input port 402*b* is used, the first pair of the four feed ports 404 having the first phase is composed of the feed ports 404*a* and 404*d*, while the second pair of the four feed ports 404 having the second phase that is opposite the first phase is composed of the feed ports 404*b* and 404*c*.

The addition of a second input port 402 to the feed network 400 configures the feed network 400 to change the polarization of the corresponding antenna (i.e., to provide dual-linearly polarized antenna operation). Specifically, changing the selection of which input port 402*a* or 402*b* is used to feed the corresponding antenna changes the composition of the first and second pairs of the feed ports 404 and thereby changes the pattern of the first and second opposite phases output through the feed ports 404. In other embodiments, the feed network 400 only includes a single input port 402, or includes more than two input ports 402. In embodiments wherein the feed network 400 only includes a single input port 402, the feed network 400 would not be capable of being electrically switched between feeding the corresponding antenna in different directions, but would still be configured to feed the corresponding antenna at the four corresponding feed points of the antenna: (1) with approximately equal amplitude; (2) with a first pair of the four feed ports 404 having a first phase; and (3) with a second pair of the four feed ports 404 having a second phase that is opposite the first phase. In embodiments wherein the feed network 400 only includes a single input port 402, the feed network 400 may include less than four 180° hybrid couplers 410 (e.g., the feed network 400 may not include the 180° hybrid coupler 410*d*).

Each of the 180° hybrid couplers 410 may have any characteristic impedance, such as, but not limited to, approximately 70.7 Ohms, approximately 50 Ohms, and/or the like. In some embodiments, one or more of the 180° hybrid couplers 410 has characteristic impedance that is different than a characteristic impedance of the input port 402*a*, the input port 402*b*, and/or the feed ports 404*a*, 404*b*, 404*c*, and/or 404*d*. For example, in the exemplary embodiment of the feed network 400, the 180° hybrid couplers 410 each have a characteristic impedance of approximately 70.7 Ohms, while the input ports 402 and the feed ports 404 each have a characteristic impedance of approximately 50 Ohms. The resistors 408*a* and 408*b* may be selected to facilitate providing the respective 180° hybrid couplers 410*a* and 410*d* with the corresponding characteristic impedance. For example, in the exemplary embodiment of the feed network 400, the resistance value of the resistors 408*a* and 408*b* is selected to facilitate providing the 180° hybrid couplers 410*a* and 410*d*, respectively, with a characteristic impedance of approximately 70.7 Ohms.

The feed network 400 may operate at any frequencies. By "operate", it is meant that the corresponding antenna is capable of transmitting and/or receiving RF waves at the particular frequencies. Examples of the operating frequencies of the feed network 400 include, but are not limited to, frequencies above approximately 0.50 GHz, frequencies of at least approximately 1.00 GHz, frequencies of at least approximately 1.50 GHz, frequencies above approximately 3.00 GHz, frequencies below approximately 3.00 GHz, frequencies below approximately 2.00 GHz, frequencies between approximately 1.00 GHz and 2.00 GHz, and/or the like. The feed network 400 may operate over a frequency band having any bandwidth. Examples of the bandwidth of the operational frequency band of the feed network 400 include, but are not limited to, approximately 200 MHz, approximately 400 MHz, approximately 500 MHz, approximately 600 MHz, and/or the like. The feed network 400 may operate at higher frequencies as compared to at least some known feed networks. The feed network 400 may have an increased bandwidth as compared to at least some known feed networks. For example, some known feed networks have a bandwidth of up to only approximately 100 MHz.

Various parameters of the feed network 400 may be selected to provide the feed network 400 with predetermined operating frequencies and/or with a predetermined bandwidth, for example to provide the increased bandwidth and/or higher operating frequencies relative to at least some known feed networks. For example, the characteristic impedance value of the each of the 180° hybrid couplers 410, the thickness and/or dielectric constant of a bonding layer (e.g., the thickness and/or dielectric constant of a substrate (e.g., the substrate 502) and/or a bonding layer (not shown)), and/or the like may be selected to provide the feed network 400 with predetermined operating frequencies and/or with a predetermined bandwidth. In one specific example, the use of more than one quarter wavelength coupling elements in one or more of the 180° hybrid couplers 410 may increase the feed network 400 and/or may configure the feed network 400 to operate at higher frequencies.

The feed network 400 may have any size. For example, the overall x dimension of the feed network 400 and the overall y dimension of the feed network 400 may each have any value. Examples of the values of each of the overall x dimension and the overall y dimension of the feed network 400 include, but are not limited to, less than approximately 2.0 inches, less than approximately 1.5 inches, less than approximately 1.0 inches, between approximately 1.0 inches and approximately 2.0 inches, and/or the like. It should be understood that the exemplary dimensions described herein of the feed network 400 are applicable to a feed network 400 having any shape in the x and y dimensions. The feed network 400 may be smaller than at least some known feed networks. For example, at least some known feed networks have x and/or y dimensions that are at least 2.0 inches.

Various parameters of the feed network 400 may be selected to provide the feed network 400 with a predetermined size, for example with predetermined values for the x and y dimensions. For example, the number, size, and/or the like of 180° hybrid couplers 410 may be selected to provide the feed network 400 with the predetermined size, for example to provide the reduced size as compared to at least some known feed networks. In one specific example, the use of one or more 180° hybrid couplers 410 designed for a characteristic impedance of 70.7 Ohms enables the maximum coupling of the hybrid couplers 410 to exceed that otherwise possible, which accomplishes an approximately 3 dB power division with only a single quarter wavelength element. The use of only a single quarter wavelength coupling element, as opposed to more than one quarter wavelength elements arranged back-to-back in tandem in at least some known feed networks, may reduce the size of the 180° hybrid couplers 410, and thus the feed network 400 overall.

The feed network 400 is not limited to including more than two 180° hybrid couplers 410. Rather, the feed network 400 may include only two 180° hybrid couplers 410. In some embodiments, the feed network 400 includes three 180° hybrid couplers 410. The feed network 400 may include as many as four 180° hybrid couplers 410.

Figure 9:
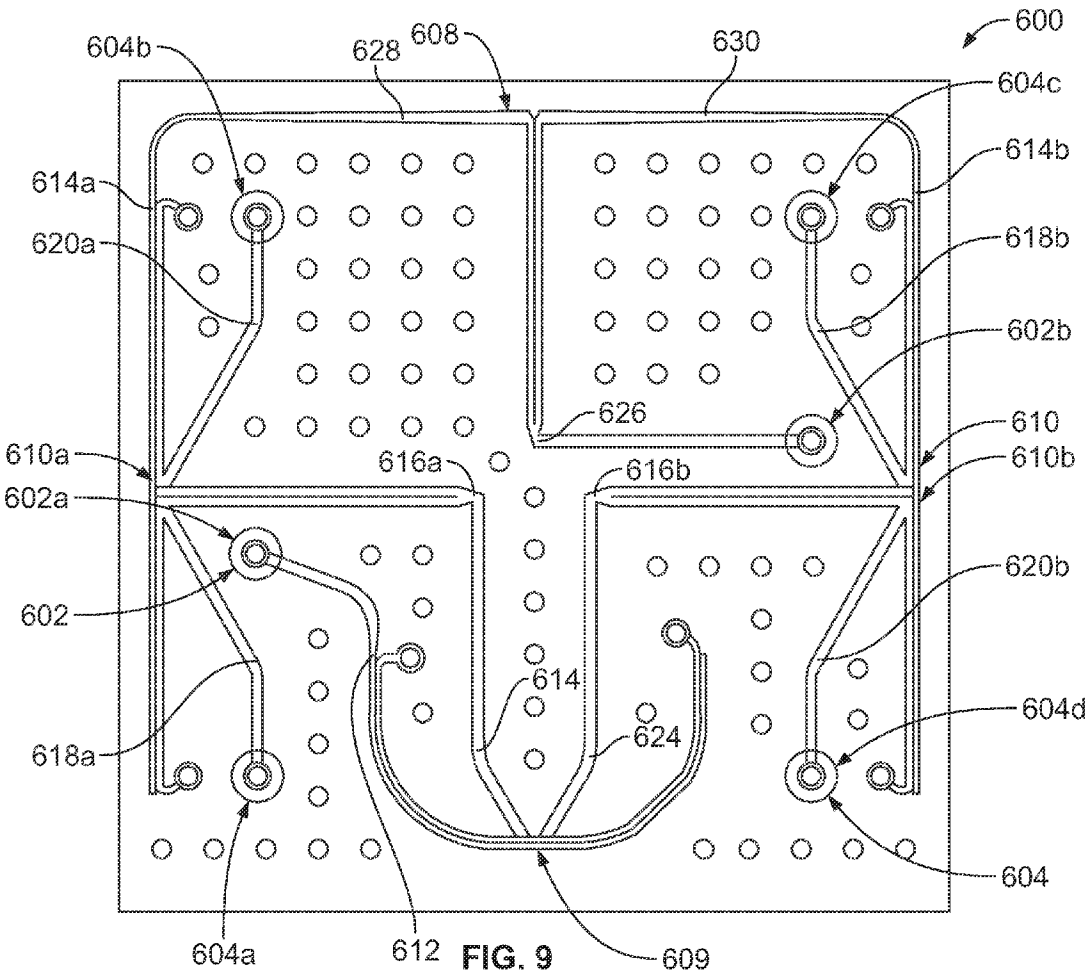
FIG. 9 is a plan view of another embodiment of a feed network for an antenna.

For example, FIG. 9 is a schematic view of another embodiment of a feed network 600 for an antenna. The feed network 600 includes two input ports 602, four feed ports 604, two 180° hybrid couplers 610, a 0° power divider 608, and a 180° power divider 609. The two input ports 602 are labeled as input ports 602*a* and 602*b*. The four feed ports 604 are labeled as feed ports 604*a*, 604*b*, 604*c*, and 604*d*. The two 180° hybrid couplers 610 are labeled as couplers 610*a* and 610*b*. Outputs 618*a* and 620*a* of the 180° hybrid coupler 610*a* define the feed ports 604*a* and 604*b*, respectively. Outputs 618*b* and 620*b* of the 180° coupled-line hybrid coupler 610*b* define the feed ports 604*c* and 604*d*, respectively.

Each of the input ports 602*a* and 602*b* may be referred to herein as a "first" and/or a "second" input port. Each of the feed ports 604*a*, 604*b*, 604*c*, and 604*d* may be referred to herein as a "first", "second", "third", and/or "fourth" feed port. Each of the 180° hybrid couplers 610*a* and 610*b* may be referred to herein as a "first" and/or a "second" 180° coupled-line hybrid coupler. The feed network 600 may include any number of each of the components 602, 604, 610, 608, and 609 that enables the feed network 600 to function as described and/or illustrated herein.

The two 180° hybrid couplers 610 are operatively connected between the input port 602*a* and the four feed ports 604 for feeding RF energy between the input port 602*a* and the four feed probes. In the exemplary embodiment, the two 180° hybrid couplers 610 are also operatively connected between the input port 602*b* and the four feed ports 604 for feeding RF energy between the input port 602*b* and the four feed probes.

The input port 602*a* drives the outputs 618*a*, 620*a*, 618*b*, and 620*b* of the respective 180° hybrid couplers 610*a* and 610*b*, and thus the respective feed ports 604*a*, 604*b*, 604*c*, and 604*d*, through the 180° power divider 609. Specifically, the 180° power divider 609 is operatively connected between the input port 602*a* and the 180° hybrid couplers 610*a* and 610*b*. More specifically, an input 612 of the 180° power divider 609 is connected to the input port 602*a*. Outputs 614 and 624 of the 180° power divider 609 are connected to respective inputs 616*a* and 616*b* of the 180° hybrid couplers 610*a* and 610*b* respectively.

The input port 602*b* drives the outputs 618*a*, 620*a*, 618*b*, and 620*b* of the respective 180° hybrid couplers 610*a* and 610*b* (and thus the respective feed ports 604*a*, 604*b*, 604*c*, and 604*d*) through the 0° power divider 608. The 0° power divider 608 is operatively connected between the input port 602*b* and the 180° coupled-line hybrid couplers 610*a* and 610*b*. Specifically, an input 626 of the 180° power divider 608 is connected to the input port 602*b*. Outputs 628 and 630 of the 180° power divider 608 are connected to respective inputs 614*a* and 614*b* of the 180° hybrid couplers 610*a* and 610*b*, respectively.

As should be appreciated from the above description and FIG. 9, the two 180° hybrid couplers 610 are electrically arranged relative to the input ports 602*a* and 602*b* and the four feed ports 604 such that the four feed ports 604 are configured to feed the corresponding antenna at the four corresponding feed points of the antenna: (1) with approximately equal amplitude; (2) with a first pair of the four feed ports 604 having a first phase; and (3) with a second pair of the four feed ports 604 having a second phase that is opposite the first phase. When the feed network 600 feeds the corresponding antenna using the input port 602*a*, the 180° hybrid coupler 610*a* receives the signal from the 180° power divider 609 through the input 616*a* of the 180° hybrid coupler 610*a*, which provides the signals at the outputs 618*a* and 620*a*, and thus at the respective feed ports 604*a* and 604*b*, with the same first phase. The 180° hybrid coupler 610*b* receives the signal from the 180° power divider 609 through the input 616*b* of the 180° hybrid coupler 610*b*, which provides the signals at the outputs 618*b* and 620*b*, and thus at the respective feed ports 604*c* and 604*d*, with the same second phase. For example, when the feed network 600 feeds the corresponding antenna using the input port 602*a*, the feed ports 604*a* and 604*b* may be provided with a phase of 0°, while the feed ports 604*c* and 604*d* are provided with a phase of 180°.

When the feed network 600 feeds the corresponding antenna using the input port 602*b*, the 180° hybrid coupler 610*b* receives the signal from the 0° power divider 608 through the input 614*b* of the 180° coupled-line hybrid coupler 610*b*, which provides the signals at the outputs 618*b* and 620*b*, and thus at the respective feed ports 604*c* and 604*d*, with respective first and second phases that are opposite each other. The 180° hybrid coupler 610*a* receives the signal from the 0° power divider 608 through the input 614*a* of the 180° hybrid coupler 610*a*, which provides the signals at the outputs 618*a* and 620*a*, and thus at the respective feed ports 604*a* and 604*b*, with the first and second phases, respectively. For example, when the feed network 600 feeds the corresponding antenna using the input port 602*b*, the feed ports 404*a* and 404*d* may be provided with a phase of 0°, while the feed ports 604*b* and 604*c* are provided with a phase of 180°.

Accordingly, when the input port 602*a* is used, a first pair of the four feed ports 604 having the first phase is composed of the feed ports 604*a* and 604*b*, while a second pair of the four feed ports 604 having the second phase that is opposite the first phase is composed of the feed ports 604*c* and 604*d*. But, when the input port 602*b* is used, the first pair of the four feed ports 604 having the first phase is composed of the feed ports 604*a* and 604*d*, while the second pair of the four feed ports 604 having the second phase that is opposite the first phase is composed of the feed ports 604*b* and 604*c*.

The addition of a second input port 602 to the feed network 600 configures the feed network 600 to change the polarization of the corresponding antenna (i.e., to provide dual-linearly polarized antenna operation). Specifically, changing the selection of which input port 602*a* or 602*b* is used to feed the corresponding antenna changes the composition of the first and second pairs of the feed ports 604 and thereby changes the pattern of the first and second opposite phases output through the feed ports 604. In other embodiments, the feed network 600 only includes a single input port 602, or includes more than two input ports 602. In embodiments wherein the feed network 600 only includes a single input port 602, the feed network 600 would not be capable of being electrically switched between feeding the corresponding antenna in different directions, but would still be configured to feed the corresponding antenna at the four corresponding feed points of the antenna: (1) with approximately equal amplitude; (2) with a first pair of the four feed ports 604 having a first phase; and (3) with a second pair of the four feed ports 604 having a second phase that is opposite the first phase.

The embodiments described and/or illustrated herein may provide a 180° hybrid coupler that operates over a wider frequency band than at least some known 180° hybrid couplers. The embodiments described and/or illustrated herein may provide a 180° hybrid coupler that operates at higher frequencies than at least some known 180° hybrid couplers. For example, eliminating electrical vias (e.g., electrical vias associated with a signal conductor that extends along the side 50 of the first signal conductor 32*a* shown in FIG. 1) may enable the 180° hybrid couplers described and/or illustrated herein to operate at higher frequencies than at least some known 180° hybrid couplers.

As should be appreciated from the Detailed Description and the Figures, the transmission line 28 may have an electrically short (i.e., small) length, which may allow a 180° hybrid coupler to operate at higher frequencies with better phase balance as compared to at least some known 180° hybrid couplers.

The embodiments described and/or illustrated herein may provide a 180° hybrid coupler that is smaller than at least some known 180° hybrid couplers. The embodiments described and/or illustrated herein may enable host and/or associated devices to include more 180° hybrid couplers as compared to using at least some known 180° hybrid couplers. The embodiments described and/or illustrated herein may enable more host and/or associated devices to be arranged in a given space.

The embodiments described and/or illustrated herein may provide a 180° hybrid coupler that is easier, less costly, and/or the like to manufacture as compared to at least some known 180° hybrid couplers. For example, the 180° hybrid couplers described and/or illustrated herein may have looser registration (i.e., alignment) requirements as compared to at least some known 180° hybrid couplers. Moreover, and for example, the 180° hybrid couplers described and/or illustrated herein are compatible with standard printed circuit manufacturing (i.e., processing) techniques.

The embodiments described and/or illustrated herein may provide a feed network that operates over a wider frequency band than at least some known feed networks. The embodiments described and/or illustrated herein may provide a feed network having a frequency band that overlaps the different frequency bands of two or more different satellite constellations. The embodiments described and/or illustrated herein may provide a feed network that is capable of communicating with two or more different satellite constellations that operate over different frequency bands. The embodiments described and/or illustrated herein may provide a feed network that operates in a plurality of different frequency sub-bands of the frequency band of a particular satellite constellation. In other words, the embodiments described and/or illustrated herein may provide a feed network having coverage over multiple frequency bands for a single satellite constellation.

The embodiments described and/or illustrated herein may provide a feed network that is smaller than at least some known feed networks. The embodiments described and/or illustrated herein may provide an array that is capable of including more feed networks, and thus more antennas, than at least some known arrays of antennas.

As used herein, an element or step recited in the singular and proceeded with the word "a" or "an" should be understood as not excluding plural of said elements or steps, unless such exclusion is explicitly stated. Furthermore, references to an "exemplary embodiment", "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A 180° hybrid coupler comprising:

a circuit having first and second inputs and first and second outputs, the circuit comprising first, second, and third coupled-line couplers and a transmission line, wherein each of the first, second, and third coupled-line couplers is defined by at least one ground conductor and first and second signal conductors, and wherein:

the first input is connected to the first signal conductor of the first coupled-line coupler at a first end of the first coupled-line coupler;

the second signal conductor of the first coupled-line coupler is terminated to ground at the first end of the first coupled-line coupler, the second signal conductor of the first coupled-line coupler is connected to the first output at a second end of the first coupled-line coupler;

the second signal conductor of the first coupled-line coupler is connected to the first signal conductor of the third coupled-line coupler at the second end of the first coupled-line coupler and at a first end of the third coupled-line coupler;

the transmission line is connected to the first signal conductor of the first coupled-line coupler at the second end of the first coupled-line coupler;

the transmission line is connected to the first signal conductor of the second coupled-line coupler at a first end of the second coupled-line coupler;

the first signal conductor of the second coupled-line coupler is terminated in an open circuit at a second end of the second coupled-line coupler;

the second signal conductor of the second coupled-line coupler is terminated to ground at the second end of the second coupled-line coupler;

the second signal conductor of the second coupled-line coupler is connected to the second output at the first end of the second coupled-line coupler;

the second signal conductor of the second coupled-line coupler is connected to the second signal conductor of the third coupled-line coupler at the first ends of the second and third coupled-line couplers;

the first and second signal conductors of the third coupled-line coupler are connected to each other at a second end of the third coupled-line coupler;

the first and second signal conductors of the third coupled-line coupler are connected to the first and second outputs, respectively, at the first end of the third coupled-line coupler; and the second input is connected to the second end of the third coupled-line coupler.

2. The 180° hybrid coupler of claim 1, wherein the signal conductors are defined by electrical traces of a printed circuit, the first signal conductors of the first and second coupled-line couplers extending on a first surface of the printed circuit, and wherein the transmission line, the second signal conductors of the first and second coupled-line couplers, and the first and second signal conductors of the third coupled-line coupler extend on a second on a second surface of the printed circuit, the first and second surfaces being spaced apart by a gap such that the first and second signal conductors of each of the first and second coupled-line couplers are offset-coupled with each other across the gap in an offset-coupled stripline topology.

3. The 180° hybrid coupler of claim 1, wherein the signal conductors are defined by electrical traces of a printed circuit, and wherein the transmission line and the first and second signal conductors of the first, second, and third coupled-line couplers extend on the same surface of the printed circuit as each other such that the first and second signal conductors of each of the first, second, and third coupled-line couplers are edge-coupled with each other in at least one of a stripline or microstrip topology.

4. The 180° hybrid coupler of claim 1, wherein at least one of the first, second, or third coupled-line couplers has an electrical length of one-quarter wavelength at the center of frequency operation.

5. The 180° hybrid coupler of claim 1, wherein at least one of the first, second, or third coupled-line couplers has an electrical length of an odd multiple of one-quarter wavelengths at the center of frequency operation.

6. The 180° hybrid coupler of claim 1, wherein at least one of the first, second, or third coupled-line couplers is non-uniformly coupled along the length thereof.

7. The 180° hybrid coupler of claim 1, wherein the circuit is configured to operate over a bandwidth of at least approximately 200 MHz.

8. The 180° hybrid coupler of claim 1, wherein the circuit is configured to operate at frequencies greater than at least one GHz.

9. A 180° hybrid coupler comprising:

first and second inputs;

first and second outputs;

first, second, and third coupled-line couplers each being defined by at least one ground conductor and only first and second signal conductors;

an electrically short transmission line connected between the first coupled-line coupler and the second coupled-line coupler; and wherein:

the first input is connected to the first signal conductor of the first coupled-line coupler at a first end of the first coupled-line coupler;

the second signal conductor of the first coupled-line coupler is terminated to ground at the first end of the first coupled-line coupler;

the second signal conductor of the first coupled-line coupler is connected to the first output at a second end of the first coupled-line coupler;

the second signal conductor of the first coupled-line coupler is connected to the first signal conductor of the third coupled-line coupler at the second end of the first coupled-line coupler and at a first end of the third coupled-line coupler;

the transmission line is connected to the first signal conductor of the first coupled-line coupler at the second end of the first coupled-line coupler;

the transmission line is connected to the first signal conductor of the second coupled-line coupler at a first end of the second coupled-line coupler;

the first signal conductor of the second coupled-line coupler is terminated in an open circuit at a second end of the second coupled-line coupler;

the second signal conductor of the second coupled-line coupler is terminated to ground at the second end of the second coupled-line coupler;

the second signal conductor of the second coupled-line coupler is connected to the second output at the first end of the second coupled-line coupler;

the second signal conductor of the second coupled-line coupler is connected to the second signal conductor of the third coupled-line coupler at the first ends of the second and third coupled-line couplers;

the first and second signal conductors of the third coupled-line coupler are connected to each other at a second end of the third coupled-line coupler;

the first and second signal conductors of the third coupled-line coupler are connected to the first and second outputs, respectively, at the first end of the third coupled-line coupler; and the second input is connected to the second end of the third coupled-line coupler.

10. The 180° hybrid coupler of claim 9, wherein the transmission line has an electrical length of zero.

11. The 180° hybrid coupler of claim 9, wherein the 180° hybrid coupler is configured to operate over a bandwidth of at least approximately 200 MHz.

12. The 180° hybrid coupler of claim 9, wherein the 180° hybrid coupler is configured to operate at frequencies greater than at least one GHz.

13. A feed network for an antenna, the feed network comprising:

first and second feed network input ports;

first, second, third, and fourth feed ports for connection to four corresponding feed points of at least one antenna;

first, second, third, and fourth 180° hybrid couplers operatively connected between the feed network input ports and the feed ports, wherein each of the first, second, third, and fourth 180° hybrid couplers comprises:

first and second inputs;

first and second outputs;

first, second, and third coupled-line couplers;

a transmission line connected between the first coupled-line coupler and the second coupled-line coupler; and wherein the first coupled-line coupler is connected between the first input and the first output and between the first input and the transmission line, the second coupled-line coupler is connected between the transmission line and the second output, and the third coupled-line coupler is connected between the second input and the first and second outputs; and wherein:

the first feed network input port is connected to the first input of the first 180° hybrid coupler;

the second input of the first 180° hybrid coupler is terminated in a matched load or another input port;

the first output of the first 180° hybrid coupler is connected to the second input of the second 180° hybrid coupler;

the second output of the second 180° hybrid coupler is connected to the second input of the third 180° hybrid coupler;

the first and second outputs of the second 180° hybrid coupler are connected to the first and second feed ports, respectively;

the first and second outputs of the third 180° hybrid coupler are connected to the third and fourth feed ports, respectively;

the first input of the second 180° hybrid coupler is connected to the first output of the fourth 180° hybrid coupler;

the first input of the third 180° hybrid coupler is connected to the second output of the fourth 180° hybrid coupler;

the first input of the fourth 180° hybrid coupler is terminated in a matched load or another input port; and the second feed network input port is connected to the second input of the fourth 180° hybrid coupler.

14. The feed network of claim 13, wherein the first, second, and third coupled-line couplers each include first and second signal conductors that are defined by electrical traces of a printed circuit, the first signal conductors of the first and second coupled-line couplers extending on a first surface of the printed circuit, and wherein the transmission line, the second signal conductors of the first and second coupled-line couplers, and the first and second signal conductors of the third coupled-line coupler extend on a second on a second surface of the printed circuit, the first and second surfaces being spaced apart by a gap such that the first and second signal conductors of each of the first and second coupled-line couplers are offset-coupled with each other across the gap in an offset-coupled stripline topology.

15. The feed network of claim 13, wherein one of the 180° hybrid couplers is a three-port 0° power divider device or balun with a common or difference port connected to the first feed network input port.

16. The feed network of claim 13, wherein one of the 180° hybrid couplers is a three-port 180° power divider device or balun with a common or difference port connected to the second feed network input port.

17. The feed network of claim 13, wherein the 180° hybrid couplers are electrically arranged relative to the feed network input ports and the feed ports such that the feed network is configured to provide dual-linearly polarized antenna operation.

18. The feed network of claim 13, wherein the feed network is configured to operate over a bandwidth of at least approximately 200 MHz.

19. The feed network of claim 13, wherein the feed network is configured to operate at frequencies greater than at least one GHz.

20. The feed network of claim 13, wherein the feed network has a physical width of less than approximately 2.0 inches (50.8 mm).

* * * * *